US010161589B2

(12) United States Patent
Chiu

(10) Patent No.: US 10,161,589 B2
(45) Date of Patent: Dec. 25, 2018

(54) PROJECTION LENS AND VEHICLE HEADLAMP HAVING THE SAME

(71) Applicant: MiiCs & Partners (Shenzhen) Co., Ltd., Shenzhen (CN)

(72) Inventor: Po-Chin Chiu, New Taipei (TW)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/408,598

(22) Filed: Jan. 18, 2017

(65) Prior Publication Data

US 2017/0299136 A1 Oct. 19, 2017

(30) Foreign Application Priority Data

Apr. 14, 2016 (TW) ..... 105111687

(51) Int. Cl.

| | |
|---|---|
| ***F21V 1/00*** | (2006.01) |
| ***F21S 41/275*** | (2018.01) |
| ***F21S 41/143*** | (2018.01) |
| ***F21S 41/20*** | (2018.01) |
| ***F21S 41/25*** | (2018.01) |
| ***F21S 41/32*** | (2018.01) |

(52) U.S. Cl.

CPC ..... *F21S 41/275* (2018.01); *F21S 41/143* (2018.01); *F21S 41/20* (2018.01); *F21S 41/25* (2018.01); *F21S 41/321* (2018.01)

(58) Field of Classification Search

CPC ..... F21S 41/275; F21S 41/25; F21S 41/143; F21S 41/20; F21S 41/321; F21V 5/002; F21V 5/004; F21V 5/005; F21V 5/008

USPC ..... 362/509

See application file for complete search history.

(56) References Cited

U.S. PATENT DOCUMENTS 5,146,365 A * 9/1992 Minoura ..... G03B 21/10 348/E5.138

2005/0248955 A1* 11/2005 Nishizawa ..... F21S 41/17 362/514

* cited by examiner

*Primary Examiner* — Anh Mai

*Assistant Examiner* — Meghan Ulanday

(74) *Attorney, Agent, or Firm* — ScienBiziP, P.C.

(57) ABSTRACT

A projection lens on a vehicle headlight includes a light incident surface and a light emitting surface facing away from the light incident surface. The light emitting surface includes a diffusing surface and a rough surface. A number of strips protrude from the diffusing surface. The strips are parallel to each other and have curved cross sections, and are configured for diffusing the light passing through the diffusing surface. The rough surface is positioned above and connected to the diffusing surface to form a horizontal connecting line, thereby allowing the rough surface to scatter the light passing through the rough surface in all directions.

18 Claims, 5 Drawing Sheets

PROJECTION LENS AND VEHICLE HEADLAMP HAVING THE SAME

FIELD

The subject matter herein generally relates to vehicle lighting and a vehicle headlamp with a projection lens.

BACKGROUND

Vehicle headlamps can comprise light sources, reflectors, and shields. The light source emits light. The reflector reflects light towards an opening of the reflector. The shield blocks a portion of the light to form a desired light pattern having a cut-off line, thereby preventing glare to from distracting a driver in an oncoming vehicle. However, the light efficiency is reduced due to the light shielded by the shield.

BRIEF DESCRIPTION OF THE DRAWINGS

Implementations of the present technology will now be described, by way of example only, with reference to the attached figures.

DETAILED DESCRIPTION

Figure 1:
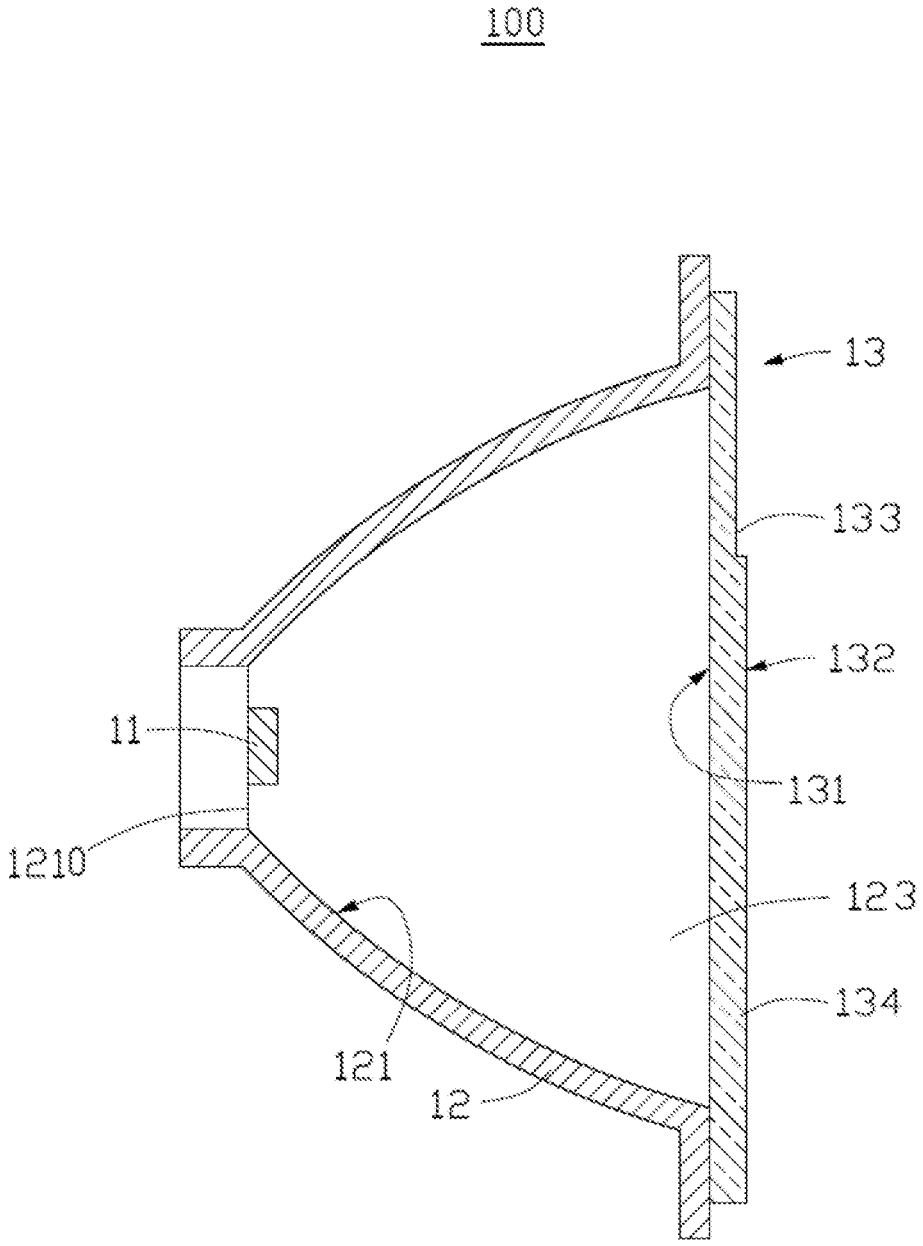
FIG. 1 is a diagrammatic view of a first exemplary embodiment of a vehicle headlamp.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Figure 2:
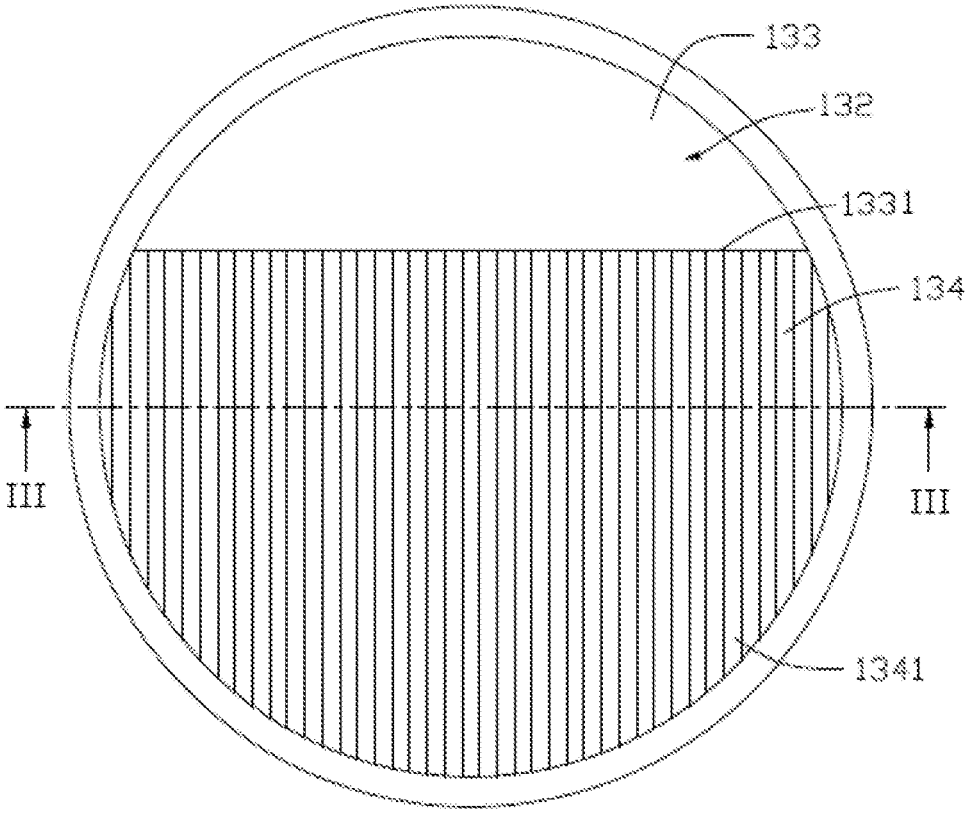
FIG. 2 is a diagrammatic view of the vehicle headlamp of FIG. 1, from another angle.
Figure 3:
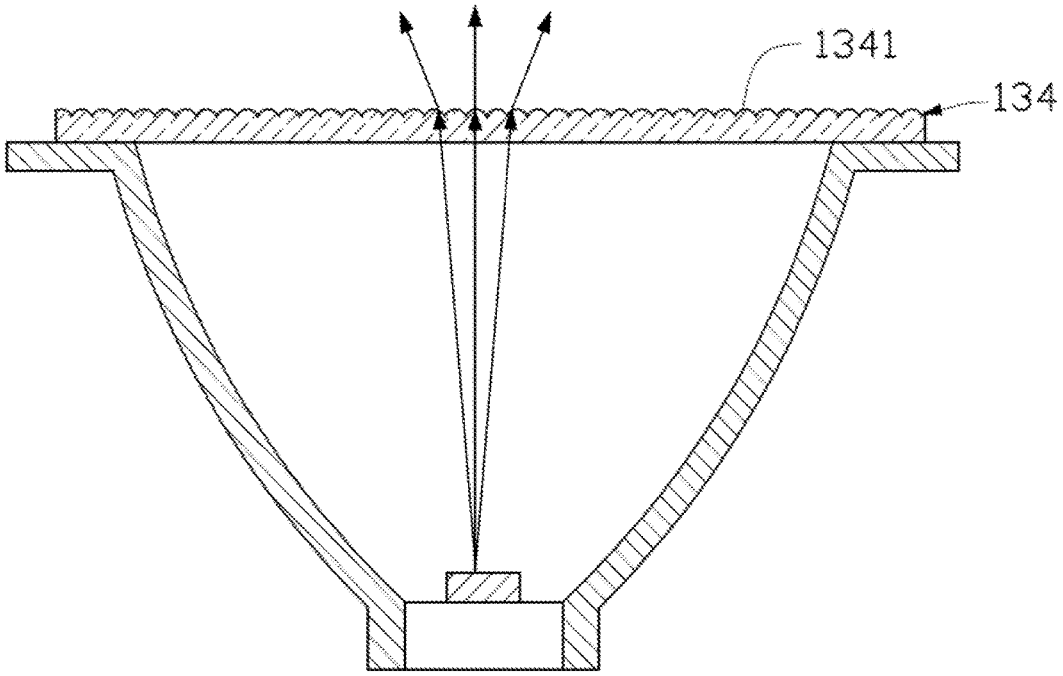
FIG. 3 is a cross-sectional view of a projection lens taken along line of FIG. 2.

FIGS. 1-3 illustrate a first exemplary embodiment of a vehicle headlamp 100. The vehicle headlamp 100 comprises a light source 11, a reflector 12, and a projection lens 13.

The light source 11 emits light. In the exemplary embodiment, the light source 11 is a light emitting diode (LED).

The reflector 12 can be substantially bowl-shaped. The reflector 12 comprises a concave inner reflecting surface 121 and an opening 123 formed by an edge of the inner reflecting surface 121. The inner reflecting surface 121 comprises a bottom portion 1210. The light source 11 is received in the reflector 12 and connected towards the bottom portion 1210. The reflector 12 reflects the light emitted by the light source 11 towards the opening 123.

The projection lens 13 covers the opening 123 of the inner reflecting surface 121. The projection lens 13 comprises a first light incident surface 131 facing the light source 11 and a first light emitting surface 132 facing away from the first light incident surface 131. In the exemplary embodiment, the first light incident surface 131 and the first light emitting surface 132 are flat. In other embodiments, the first light incident surface 131 can be concaved towards the first light emitting surface 132, and the first light emitting surface 132 can be convexed away from the first light incident surface 131.

Referring to FIG. 2, the first light emitting surface 132 comprises a diffusing surface 134 and a rough surface 133. The rough surface 133 is positioned above and connected to the diffusing surface 134. The connecting line 1331 between the rough surface 133 and the diffusing surface 134 is parallel to the horizontal plane (that is, parallel to the ground).

A plurality of strips 1341 protrudes from the diffusing surface 134. In the exemplary embodiment as shown in FIG. 3, the strips 1341 are parallel to each other and have curved cross sections. In the exemplary embodiment, the strips 1341 have substantially semi-elliptic or semi-circular cross sections. As such, the strips 1341 can diffuse the light passing through the diffusing surface 134 to transversely elongate the light pattern generated by the light source 11 (as shown in FIG. 3), thereby allowing the light pattern to meet the Standard Specification for vehicle lamps. In the exemplary embodiment, the strips 1341 can form an elliptical or a rectangular light pattern. To change the desired light pattern as needed, heights of the strips 1341 with respect to the diffusing surface 134, and widths of the strips 1341 along the connecting line 1331 can vary. In the exemplary embodiment, the strips 1341 have same heights but different widths. The widths of the strips 1341 decrease towards a direction away from a center of the diffusing surface 134. In another embodiment, the strips 1341 have different heights but same widths. The heights of the strips 1341 increase towards a direction away from the center of the diffusing surface 134. In other embodiments, the strips 1341 have different heights and different widths.

In the exemplary embodiment, the strips 1341 can be integrally formed with the diffusing surface 134 of the projection lens 13. The reflective index of each strips 1341 can be equal to that of the projection lens 13. In other embodiments, the strips 1341 can be connected to the diffusing surface 134 through a transparent adhesive (not shown). The reflective index of the transparent adhesive is equal to that of each strips 1341 and the projector lens 13.

The rough surface 133 is formed by a coarsening, grinding, or sand-blasting process. As such, the rough surface 133 can scatter the light passing through the rough surface 133 in all directions, thereby decreasing the intensity of the light passing through the rough surface 133 and preventing glare from distracting a driver in an oncoming vehicle. A desired light pattern having a cut-off line can be formed.

In other embodiments, the first light incident surface 131 can also be a roughed surface formed by a coarsening, grinding, or sand-blasting process.

With the above configuration, the strips 1341 can diffuse the light passing through the diffusing surface 134 to transversely elongate the light pattern generated by the light source 11, which allowing the light pattern to meet the Standard Specification for vehicle lamps. The rough surface 133 can scatter the light passing through the rough surface 133 in all directions, thereby decreasing the intensity of the light passing through the rough surface 133 and preventing glare from distracting a driver in an oncoming vehicle, and finally forming a desired light pattern having a cut-off line. Since no shields are needed, the efficiency of light output is improved.

Figure 4:
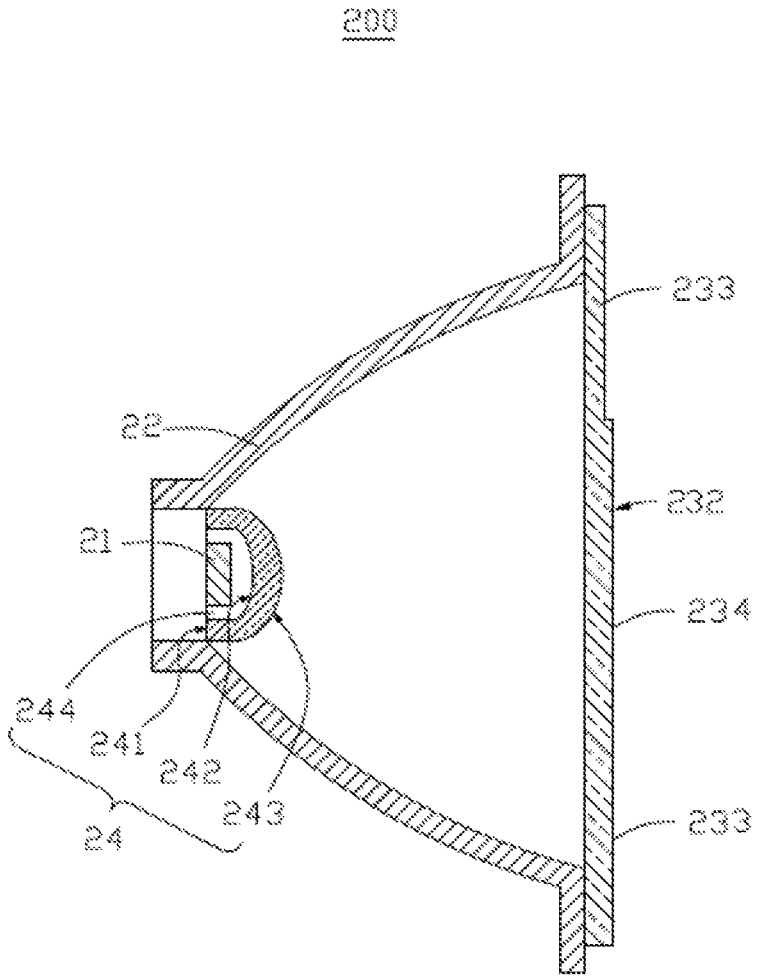
FIG. 4 is a diagrammatic view of a second exemplary embodiment of the vehicle headlamp.
Figure 5:
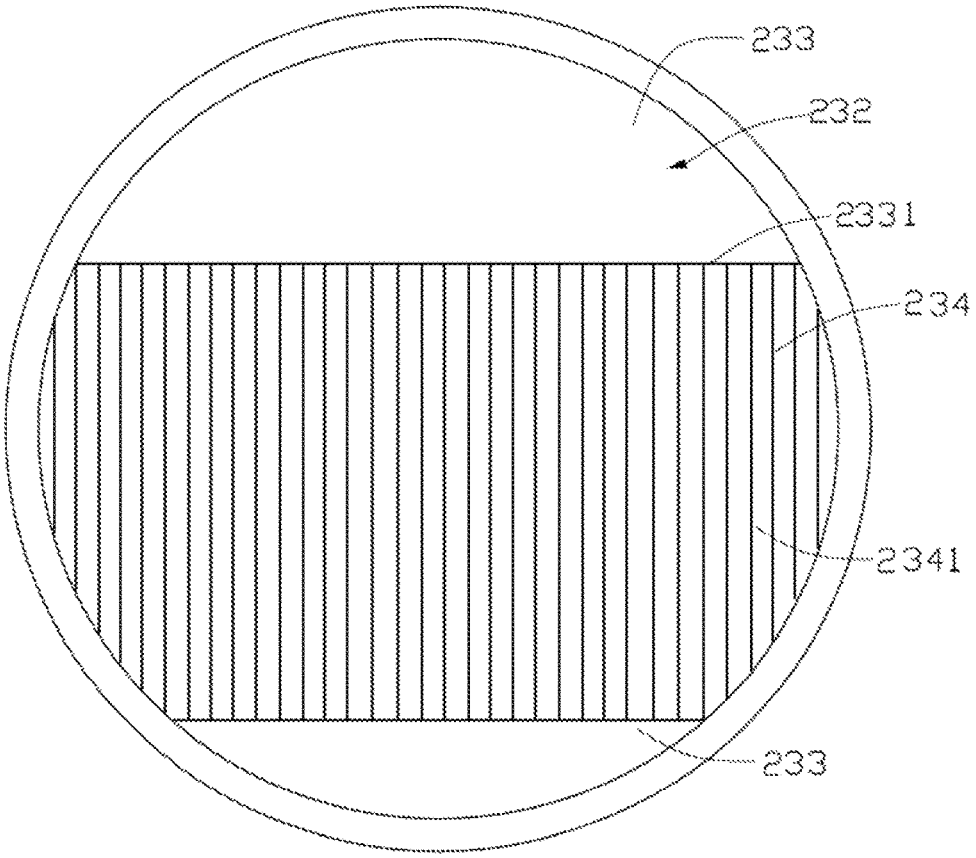
FIG. 5 is a diagrammatic view of the vehicle headlamp of FIG. 4, from another angle.

FIGS. 4 and 5 illustrate a second exemplary embodiment of a vehicle headlamp 200. The difference between the vehicle headlamp 200 and the vehicle headlamp 100 is that the vehicle headlamp 200 further comprises a secondary lens 24.

The secondary lens 24 is received in the reflector 22. The secondary lens 24 can be substantially bowl-shaped and cover the light source 21. The secondary lens 24 can diffuse the light emitted by the light source 21. In the exemplary embodiment, the secondary lens 24 comprises a second light incident surface 242 facing the light source 21, a second light emitting surface 243 facing away from the second light incident surface 242, and a bottom surface 241 connecting the second light incident surface 242 and the second light incident surface 242. The second light incident surface 242 and the second light emitting surface 243 convex away from the light source 21, thereby defining a receiving space 244 for receiving the light source 21.

The first light emitting surface 232 further comprises another rough surface 233 positioned below the diffusing surface 234, that is, the diffusing surface 234 is positioned between the two first portions 233. An area of the rough surface 233 positioned above the diffusing surface 234 is greater than an area of the rough surface 233 positioned below the diffusing surface 234.

Even though information and advantages of the present exemplary embodiments have been set forth in the foregoing description, together with details of the structures and functions of the present exemplary embodiments, the disclosure is illustrative only. Changes may be made in detail, especially in matters of shape, size, and arrangement of parts within the principles of the present exemplary embodiments, to the full extent indicated by the plain meaning of the terms in which the appended claims are expressed.

What is claimed is:

1. A projection lens comprising:
- a light incident surface; and
- a light emitting surface facing away from the light incident surface, the light emitting surface comprising:
  - a diffusing surface, the diffusing surface including a plurality of strips protruding from the diffusing surface; wherein the strips are parallel to each other and have curved cross sections, and the diffusing surface diffuses light passing through the diffusing surface to transversely elongate a light pattern;
  - a rough surface, the rough surface positioned above and connected to the diffusing surface to form a horizontal connecting line between the rough surface and the diffusing surface, wherein the rough surface scatters the light passing through the rough surface in all directions; and
  - another rough surface positioned below the diffusing surface, an area of the rough surface positioned above the diffusing surface is greater than an area of the rough surface positioned below the diffusing surface.

2. The projection lens of claim 1, wherein the strips have same heights with respect to the diffusing surface and different widths along the connecting line, the widths of the strips decrease towards a direction away from a center of the diffusing surface.

3. The projection lens of claim 1, wherein the strips have different heights with respect to the diffusing surface and same widths along the connecting line, the heights of the strips increase towards a direction away from a center of the diffusing surface.

4. The projection lens of claim 1, wherein the strips have substantially semi-elliptic or semi-circular cross sections.

5. The projection lens of claim 1, wherein the strips are integrally formed with the diffusing surface, and a reflective index of each of the plurality of strips is equal to that of the projection lens.

6. The projection lens of claim 1, wherein the strips are connected to the diffusing surface through a transparent adhesive, and a reflective index of the transparent adhesive is equal to that of each of the plurality of strips and the projector lens.

7. The projection lens of claim 1, wherein the light incident surface is a roughed surface.

8. The projection lens of claim 1, wherein the light incident surface and the light emitting surface are flat.

9. The projection lens of claim 1, wherein the light incident surface is concaved towards the light emitting surface, and the light emitting surface is convexed away from the light incident surface.

10. A vehicle headlamp comprising:
- a light source for emitting light;
- a reflector comprising a concave inner reflecting surface and an opening formed by an edge of the inner reflecting surface, the inner reflecting surface having a bottom portion, the light source received in the reflector and connected towards the bottom portion; and
- a projection lens covering the opening and comprising:
  - a first light incident surface facing the light source; and
  - a first light emitting surface facing away from the first light incident surface, the light emitting surface comprising:
    - a diffusing surface, the diffusing surface including a plurality of strips protruding from the diffusing surface; wherein the strips are parallel to each other and have curved cross sections, and the diffusing surface diffuses light passing through the diffusing surface to transversely elongate a light pattern;
  - a rough surface, the rough surface positioned above and connected to the diffusing surface to form a horizontal connecting line between the rough surface and the diffusing surface, wherein the rough surface scatters the light passing through the rough surface in all directions; and
    - another rough surface positioned below the diffusing surface, an area of the rough surface positioned above the diffusing surface is greater than an area of the rough surface positioned below the diffusing surface.

11. The vehicle headlamp of claim 10, further comprising a secondary lens, wherein the secondary lens is received in the reflector and covers the light source.

12. The vehicle headlamp of claim 11, wherein secondary lens comprises a second light incident surface facing the light source, a second light emitting surface facing away from the second light incident surface, and a bottom surface connecting the second light incident surface and the second light emitting surface, the second light incident surface and the second light emitting surface convex away from the light source, thereby defining a receiving space for receiving the light source.

13. The vehicle headlamp of claim 10, wherein the strips have same heights with respect to the diffusing surface and different widths along the connecting line, the widths of the strips decrease towards a direction away from a center of the diffusing surface.

14. The vehicle headlamp of claim 10, wherein the strips have different heights with respect to the diffusing surface and same widths along the connecting line, the heights of the strips increase towards a direction away from a center of the diffusing surface.

15. The vehicle headlamp of claim 10, wherein the strips have substantially semi-elliptic or semi-circular cross sections.

16. The vehicle headlamp of claim 10, wherein the strips are connected to the diffusing surface through a transparent adhesive, and a reflective index of the transparent adhesive is equal to that of each of the plurality of strips and the projector lens.

17. The vehicle headlamp of claim 10, wherein the light incident surface is a roughed surface.

18. The vehicle headlamp of claim 10, wherein the light incident surface is concaved towards the light emitting surface, and the light emitting surface is convexed away from the light incident surface.

* * * * *